US012687310B2

(12) United States Patent
Park et al.

(10) Patent No.: US 12,687,310 B2
(45) Date of Patent: Jul. 21, 2026

(54) ELECTRIC ADAPTER TYPE CONTROLLER FOR AIR CONDITIONER OUTDOOR UNIT AUXILIARY COOLING DEVICE

(71) Applicant: EASYX Co., Ltd., Cheonan-si (KR)

(72) Inventors: Sang Cheol Park, Cheonan-si (KR); Jung Won Park, Cheonan-si (KR)

(73) Assignee: EASYX Co., Ltd., Cheonan-si (KR)

( * ) Notice: Subject to any disclaimer, the term of this patent is extended or adjusted under 35 U.S.C. 154(b) by 471 days.

(21) Appl. No.: 18/252,746

(22) PCT Filed: Sep. 6, 2021

(86) PCT No.: PCT/KR2021/012044

§ 371 (c)(1),
(2) Date: May 12, 2023

(87) PCT Pub. No.: WO2022/055202

PCT Pub. Date: Mar. 17, 2022

(65) Prior Publication Data

US 2024/0003554 A1 Jan. 4, 2024

(30) Foreign Application Priority Data

Sep. 14, 2020 (KR) ..... 10-2020-0117387

(51) Int. Cl.

| | |
|---|---|
| ***F24F 1/16*** | (2011.01) |
| ***F24F 1/24*** | (2011.01) |
| ***F24F 11/46*** | (2018.01) |
| ***F24F 11/88*** | (2018.01) |

(52) U.S. Cl.

CPC ..... *F24F 1/16* (2013.01); *F24F 1/24* (2013.01); *F24F 11/46* (2018.01); *F24F 11/88* (2018.01)

(58) Field of Classification Search

None

See application file for complete search history.

(56) References Cited

FOREIGN PATENT DOCUMENTS

| | | | |
|---|---|---|---|
| CN | 110748970 | A | 2/2020 |
| KR | 10-2008-0047242 | A | 5/2008 |
| KR | 10-2013-0009526 | A | 1/2013 |

(Continued)

OTHER PUBLICATIONS

Machine Translation of KR-20220019211-A (Description) (Year: 2022).*

(Continued)

*Primary Examiner* — Ryan A Jarrett

(74) *Attorney, Agent, or Firm* — Studebaker Brackett PLLC

(57) ABSTRACT

The present disclosure relates to an electric adapter type controller for air conditioner outdoor unit auxiliary cooling device and, in more detail, an electric adapter type controller for air conditioner outdoor unit auxiliary cooling device that can measure used-power and check the operation of an outdoor unit installed outside on the basis of power that is consumed, by connecting an electrical outlet (wall socket, etc.) and the plug of an electric device (an air conditioner, a water tank cooler, etc.) to each other using an adapter even without specific electric equipment, and that can reduce the temperature of the outdoor unit and increase heat exchange efficiency by spraying micro-particle cooling water to the surface of a heat exchanger of the outdoor unit.

3 Claims, 3 Drawing Sheets

(56) References Cited

FOREIGN PATENT DOCUMENTS

| | | | | | |
|---|---|---|---|---|---|
| KR | 10-1443841 | B1 | | 9/2014 | |
| KR | 10-1801069 | B1 | | 11/2017 | |
| KR | 10-2018-0081366 | A | | 7/2018 | |
| KR | 10-2224193 | B1 | | 3/2021 | |
| KR | 20220019211 | A | * | 2/2022 | ..... F24F 11/46 |

OTHER PUBLICATIONS

Machine Translation of KR-20220019211-A (Claims) (Year: 2022).*
International Search Report issued in PCT/KR2021/012044; mailed Dec. 3, 2021.
International Preliminary Report on Patentability (Chapter I) and Written Opinion of the International Searching Authority issued in PCT/KR2021/012044; issued Mar. 7, 2023.

* cited by examiner

ELECTRIC ADAPTER TYPE CONTROLLER FOR AIR CONDITIONER OUTDOOR UNIT AUXILIARY COOLING DEVICE

CROSS-REFERENCE TO RELATED APPLICATIONS

The present application is a U.S. National Phase Entry of International Patent Application No. PCT/KR2021/012044, filed on Sep. 6, 2021, which is based upon and claims the benefit of priority to Korean Patent Application No. 10-2020-0117387, filed on Sep. 14, 2020. The disclosures of the above-listed applications are hereby incorporated by reference herein in their entirety.

FIELD OF THE INVENTION

This achievement (intellectual property rights) was supported by the research project of the Ministry of SMEs and Startups (detailed project number: S3318527).

The present disclosure relates to an electric adapter type controller for air conditioner outdoor unit auxiliary cooling device and, in more detail, an electric adapter type controller for air conditioner outdoor unit auxiliary cooling device that can check the operation of an outdoor unit installed outside by measuring power, which is consumed, only by connecting an electrical outlet (wall socket, etc.) and the plug of an electric device (an air conditioner, a water tank cooler, etc.) to each other using an adapter even without specific electric equipment, and that can rapidly reduce the temperature of the outdoor unit and improve heat exchange efficiency by performing control to spray micro-particle cooling water to the surface of a heat exchanger of the outdoor unit by connecting and disconnecting a valve in a water supply line.

DESCRIPTION OF THE RELATED ART

In general, an air conditioner is an apparatus that adjusts temperature, humidity, airflow, distribution, etc. suitable for activity of human and removes dust in the air using a refrigeration cycle. A refrigeration cycle has, as main components, a compressor, a condenser, an evaporator, a blowing fan, etc.

Such air conditioners are divided into an indoor unit and an outdoor unit, and the indoor unit is installed inside and the outdoor unit is installed outside.

In general, as for an outdoor unit, when it is an air-cooling type, heat is exchanged between outdoor air and a refrigerant at an outdoor heat exchanger and a fan that sends outdoor air for smooth heat exchange between the outdoor air and the refrigerant is included.

Such air conditioners transmit indoor thermal energy to an outdoor unit through a refrigerant flowing at low temperature and low pressure through an indoor unit and compression heat of a refrigerant compressor is also added, whereby the refrigerant flowing into the heat exchanger of the outdoor unit enters a high-temperature high-pressure state.

In this process, the refrigerant flowing in the heat exchanger exchanges heat with internal air that flows by operation of a cooling fan, but there is a problem that when the outdoor temperature is high, cooling efficiency is low and power consumption increases.

A "Sprinkling water and atomizing apparatus, direct expansion air handling unit with the same and control method thereof" has been proposed to solve this problem in the related art.

The related art is configured to be able to have evaporation cooling effect by sprinkling and finely spraying water in an indirect spray type to an air conditioner when indoor temperature is high.

That is, when the rated capacity of a condenser is exceeded due to high temperature in the hot season of summer, at high-temperature areas, etc., high pressure trouble is generated and power usage increases, so temperature is controlled by spraying water to reduce the lifespan of equipment.

However, it is possible to control the temperature of a heat exchanger by always spraying water to an outdoor unit, but power and water are additionally used to spray water, so there is a problem that efficient energy consumption is not achieved.

Further, there is a problem that the humidity of the inside and the sealed surrounding space increases due to the water that is always sprayed to an outdoor unit, so the heat exchange efficiency decreases and the wall with which an outdoor unit is in close contact, etc. are damaged by humidity.

Further, there is a problem that water that is supplied for a long time removes dust, etc. and forms a water film on a protective net through which air flows, whereby the flow of air becomes poor.

DETAILED DESCRIPTION

Technical Objective

The present disclosure has been made in an effort to solve the problems described above and an objective of the present disclosure is to provide an electric adapter type controller for air conditioner outdoor unit auxiliary cooling device, the controller being able to cool an outdoor unit by spraying cooling water on the basis of power usage by an indoor unit and the outdoor unit when the outdoor unit is operated.

Another objective of the present disclosure is to provide an electric adapter type controller for air conditioner outdoor unit auxiliary cooling device, the controller being able to be easily installed and used by ordinary people because the controller is simply installed between an electrical outlet and a plug and measures power usage, and is simply installed in an outdoor unit and can control spraying of cooling water.

Another objective of the present disclosure is to provide an electric adapter type controller for air conditioner outdoor unit auxiliary cooling device, the controller being able to reduce power consumption due to high temperature by spraying cooling water to a condenser and being able to efficiently use cooling water and reduce the consumption of cooling water by spraying cooling water when an outdoor unit is operated.

Another objective of the present disclosure is to provide an electric adapter type controller for air conditioner outdoor unit auxiliary cooling device, the controller enabling even ordinary people to easily change the setting thereof in correspondence to various external changes such as a position and an environment.

In order to achieve the objectives, the present disclosure includes: an adapter disposed between a plug of an air conditioner and an electrical outlet and measuring used-power; and a sprayer installed at the outdoor unit and spraying cooling water, which flows inside from the outside, to a heat exchanger in correspondence to used-power of the adapter, in which the adapter includes: a measurement module measuring consumption of power that is supplied to the plug from the electrical outlet; an operation module determining an operation state of the outdoor unit by calculating the power measured by the measurement module; and a control unit controlling the sprayer on the basis of information determined by the operation module.

It is preferable that the operation module compares power measured by the measurement module with a set reference value, determines that the outdoor unit is not operated when the measured power is smaller than the reference value, and determines that the outdoor unit is in operation and transmits whether the outdoor unit is operated to the control unit when the measured power is larger than the reference value, and the control unit controls the sprayer to be able to spray cooling water in accordance with a setting value when receiving that the outdoor unit is operated from the operation module.

It is preferable that the adapter further includes a power unit supplying power to the measurement module, the operation module, and the control unit through rectification by parallel-branching a current that is supplied to the plug from the electrical outlet.

The present disclosure further includes a set button setting the calculation module and the control unit included in the adapter, and it is preferable that the set button adjusts spraying and time through the operation module and the control unit.

It is preferable that the sprayer includes: a supply hose into which cooling water flows from the outside; a control valve installed on the supply hose and controlling supply of cooling water by the control unit; and a distribution pipe coupled to the outdoor unit and having several spray nozzles configured to spray cooling water, which comes from the supply hose, to the heat exchanger.

According to the electric adapter type controller for air conditioner outdoor unit auxiliary cooling device of the present disclosure, there is an effect that it is possible to cool a condenser by spraying cooling water on the basis of power usage of an indoor unit and an outdoor unit when the outdoor unit is operated.

According to the present disclosure, it is possible to simply install an adapter between an electrical outlet and a plug and measure power usage and it is possible to simply install a sprayer at an outdoor unit and control spraying of cooling water, so even ordinary people can easily install and use them.

According to the present disclosure, there is an advantage that it is possible to reduce power usage that is increased by high-temperature heat by spraying cooling water to a heat exchanger and it is possible to reduce consumption by efficiently using cooling water by spraying cooling water when an outdoor unit is operated.

According to the present disclosure, there is an effect that even ordinary people can easily set and adjust a reference value and a setting value in accordance with various external changes such as installation position, environment, etc. of an outdoor unit.

According to the present disclosure, there is an advantage that it is possible to efficiently consume power and cooling water by controlling a reference value and a setting value.

BEST MODE

Hereafter, an electric adapter type controller for air conditioner outdoor unit auxiliary cooling device according to the present disclosure is described in detail with reference to the accompanying drawings.

Figure 1:
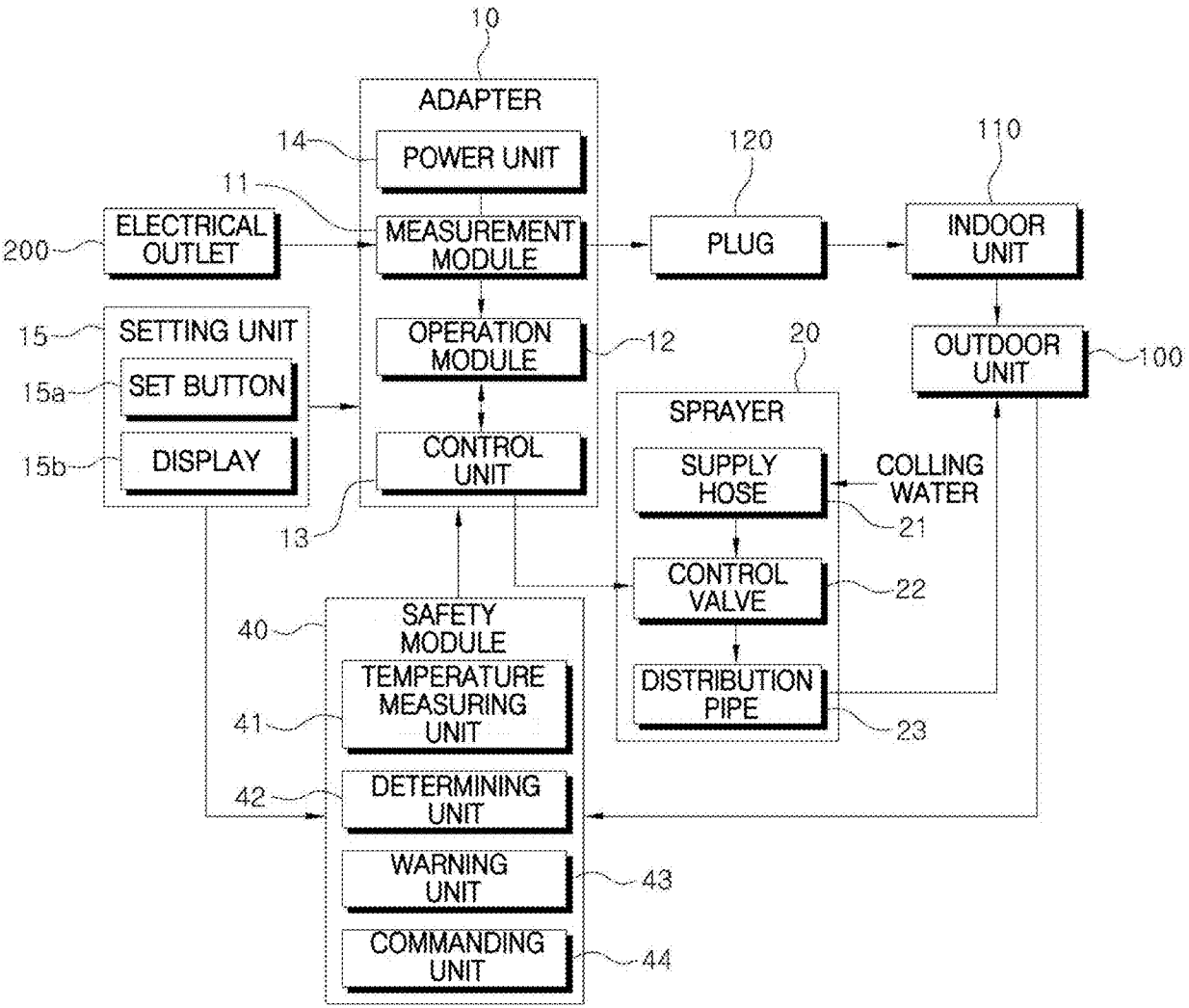
FIG. 1 is a conceptual diagram of an electric adapter type controller for air conditioner outdoor unit auxiliary cooling device according to the present disclosure.
Figure 2:
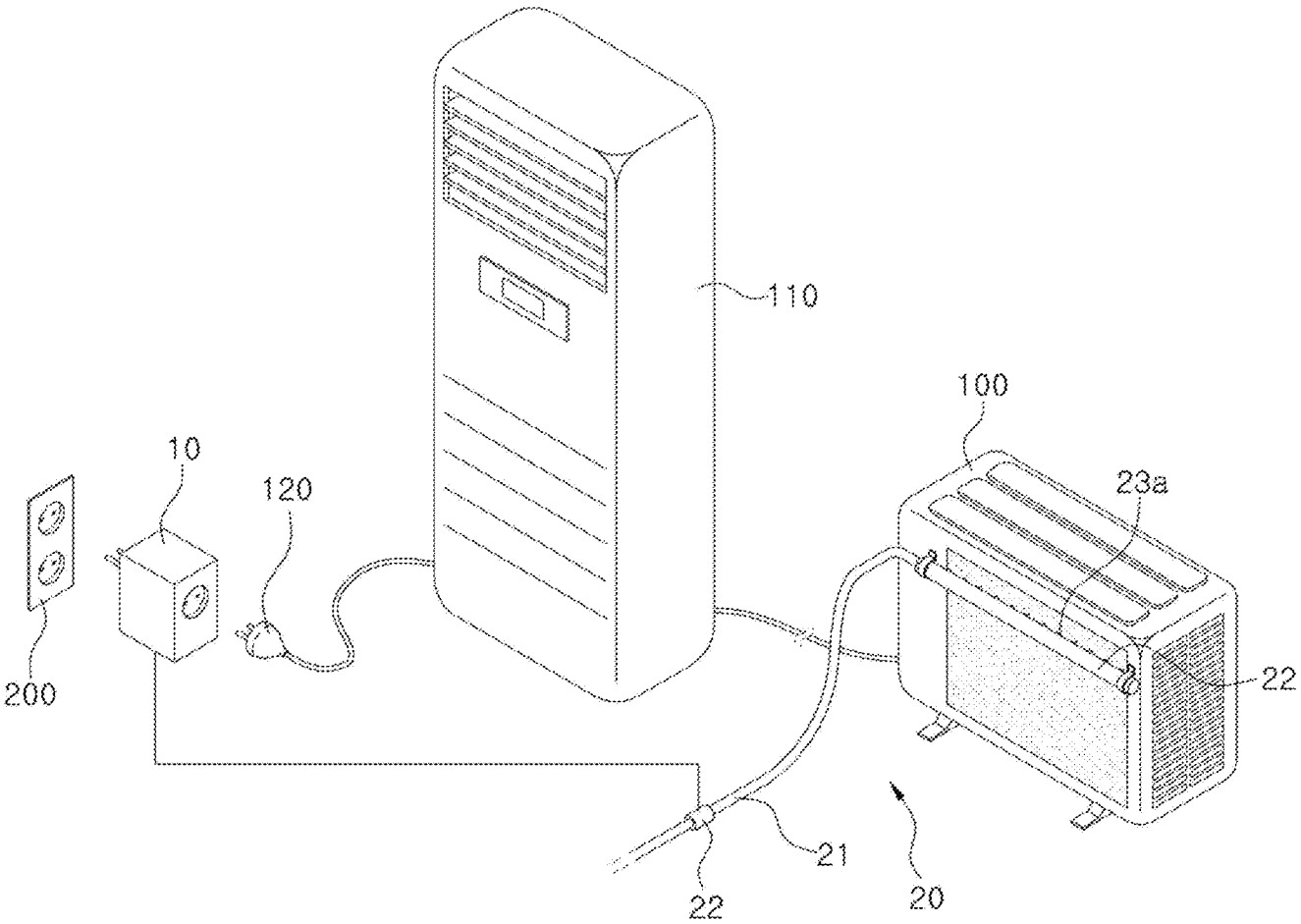
FIG. 2 is a perspective view showing an installation state of a sprayer according to the present disclosure.
Figure 3:
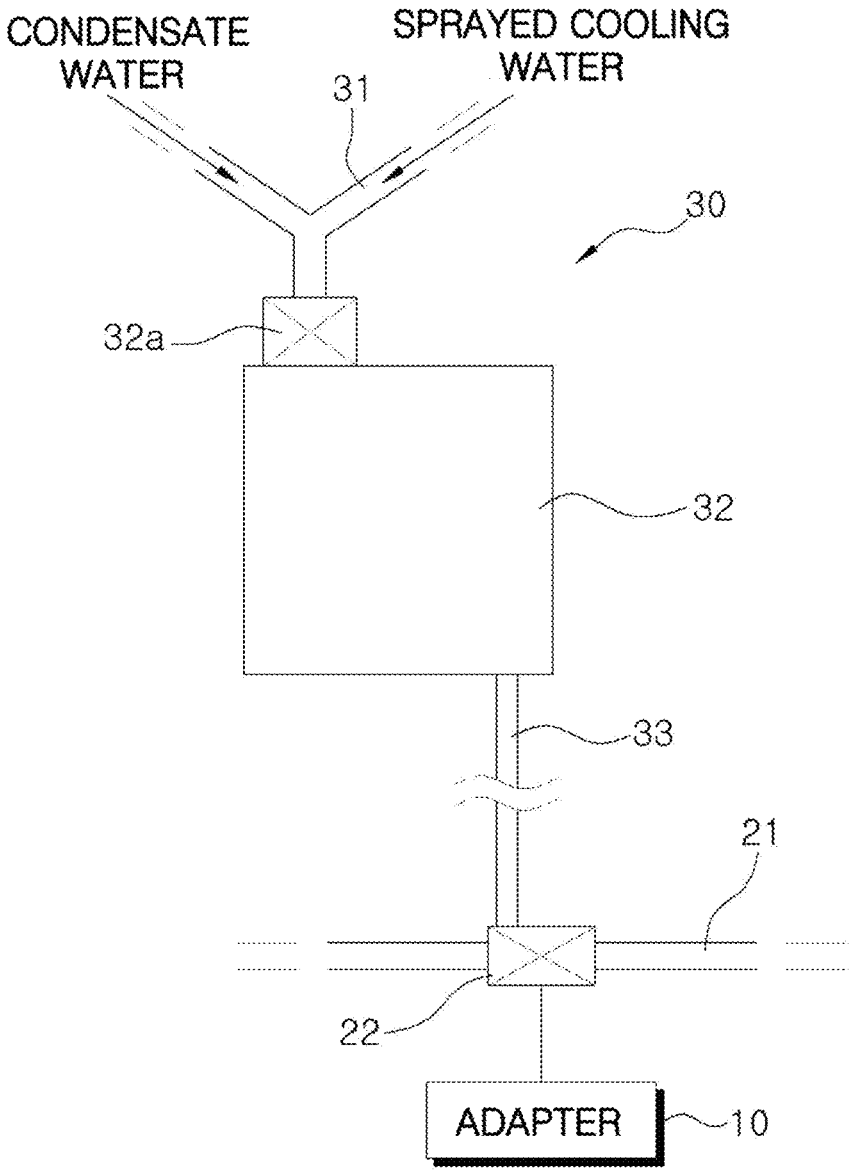
FIG. 3 is a conceptual diagram showing a circulator according to the present disclosure.

FIG. 1 is a conceptual diagram of an electric adapter type controller for air conditioner outdoor unit auxiliary cooling device according to the present disclosure, FIG. 2 is a perspective view showing an installation state of a sprayer according to the present disclosure, and FIG. 3 is a conceptual diagram showing a circulator according to the present disclosure.

As shown in FIGS. 1 to 3, the present disclosure relates to an electric adapter type controller for air conditioner outdoor unit auxiliary cooling device and, in more detail, an electric adapter type controller for air conditioner outdoor unit auxiliary cooling device, the controller being able to increase heat exchange efficiency by checking operation of an outdoor unit disposed outdoors on the basis of power, which is consumed, and by reducing the temperature of the outdoor unit by spraying micro-particle cooling water to the surface of a heat exchanger.

To this end, the present disclosure includes an adapter 10 and a sprayer 20 to be able to determine whether an outdoor unit is operated and to spray water on the basis of usage of power.

The adapter 10 is disposed between a plug 120 of an air conditioner and an electrical outlet and measures used-power.

The sprayer 20 is installed at an outdoor unit 100 and sprays cooling water, which flows inside from the outside, to a heat exchanger in correspondence to used-power of the adapter 10.

That is, the adapter 10 can control the temperature of a heat exchanger by measuring used-power, determine whether the outdoor unit 100 is operated on the basis of the measured power, and spraying cooling water through the sprayer 20.

Accordingly, it is possible to simply installed and use the controller at the outdoor unit 100 that is being currently used without specific difficulties and it is possible to reduce usage of power by operating using micro-current in correspondence to power that is generated when the outdoor unit 100 is operated.

To this end, components are described in more detail hereafter.

First, the adapter 10 determines whether the outdoor unit 100 is operated on the basis of usage of power and then controls the sprayer 20 to be able to spray cooling water.

To this end, the adapter 10 is composed of a measurement module 11, an operation module 12, and a control unit 13.

The measurement module 11 measures power that is supplied to the plug 120 from the electrical outlet 200.

The measurement module 11 includes an ammeter that measures and calculates a current, which is supplied, into digital information, etc.

Accordingly, it is possible to quantify a power amount that is used by the air conditioner.

The operation module 12 determines the operation state of the outdoor unit 100 by calculating the power measured by the measurement module 11.

Accordingly, the operation module 12 sets a reference value that enables a user to determine whether it is operated on the basis of a power amount that is generated when the indoor unit 110 and the outdoor unit 100 of the air conditioner are operated.

The reference value usually determines a reference in preparation for a power amount that is generated when only the indoor unit 110 and a power amount that is generated when the indoor unit 110 and the outdoor unit 100 are operated.

That is, power of about 150 W or less per hour is used when only the indoor unit 110 is operated, and power of about 500 W or more per hour is consumed when both the indoor unit 110 and the outdoor unit 100 are operated.

Accordingly, a value between about 200 to 400 W that makes it possible to discriminate power usage that is generated when the indoor unit 110 and the outdoor unit 100 are separately or simultaneously operated is set as the reference value.

Further, as the result of comparing power measured by the measurement module 11 with the set reference value, when the measured power is smaller than the reference value, it is determined that the outdoor unit 100 is not operated, and when the measured power is larger than the reference value, it is determined that the outdoor unit 100 is in operation, whereby whether the outdoor unit 100 is operated is transmitted to the control unit 13.

Accordingly, a user determines whether the outdoor unit 100 is operated by measuring power amounts that are used over/under the set reference value through the measurement module 11.

Further, since power consumption depends on the size, capacity, efficiency, etc. of air conditioners, it is possible to change a reference value to correspond to a power amount, which is generated when the indoor unit 110 and the outdoor unit 100 are operated, on the basis of known power consumption.

The control unit 13 controls the sprayer 20 on the basis of the information determined by the operation module 12.

The control unit 13 receives the information whether the outdoor unit 100 is operated from the operation module 12, and controls the sprayer 20 to be able to spray cooling water to the heat exchanger when the outdoor unit 100 is operated.

The control unit 13 controls the sprayer 20 when the outdoor unit 100 is operated, whereby cooling water is sprayed in correspondence to a setting value.

Accordingly, the sprayer 20 is repeatedly operated in accordance with a specific cycle in correspondence to setting values that are set by a user to set a spraying time and a hold time of the sprayer 20.

That is, the control unit 13 sets an operation time, a maintenance time, a hold time, a restart time, etc. and operates in accordance with a pattern based on the set times.

The operation time is the time at which spraying is started when the speed of a fan sufficiently reaches a normal state after the fan starts operating, the maintenance time is the time for which spraying is maintained from the point in time of starting spraying after the delay time, the hold time is the time for which spraying is stopped and held after the maintenance time, and the restart point in time is the point in time at which spraying is restarted when the outdoor unit keeps operating even after the hold time, whereby it has a pattern of spraying cooling water for the maintenance time after the restart point in time.

For example, when the operation time is set as 2 seconds, the maintenance time is set as 5 seconds, and the hold time is set as 1.0 minutes, the control unit 13 controls the sprayer 20 to spray water for 5 seconds in 2 seconds after it is determined that the outdoor unit 100 is in operation, and if the outdoor unit keeps operating even after the hold time, restarting is performed and spraying is performed for the maintenance time of 5 seconds.

Accordingly, it is possible to set time in detail in the units of hour, minute, second, etc. in correspondence to setting values, it is possible to reduce use of power and cooling water by operating in accordance with a predetermined cycle, and it is possible to remove heat generated by the heat exchanger through efficient operation.

The adapter 10 further includes a power unit 14 that supplies power to the measurement module 11, the operation module 12, and the control unit 13 through rectification by parallel-branching a current that is supplied to the plug 120 from the electrical outlet 200.

That is, the power unit 14 supplies power to the adapter 10 through rectification by parallel-branching the current that is supplied from the electrical outlet 200.

Accordingly, the power unit 14 can operate through rectification, so it is not required to prepare or connect specific operation power.

Further, a set button 15*a* setting the operation module 12 and the control unit 13 included in the adapter 10 is further included.

The set button 15*a* adjusts spraying, timing, and time through the operation module 12 and the control unit 13.

Accordingly, the set button 15*a* is connected in terms of circuit to be able to adjust the spraying start, operation time, maintenance time, hold time, etc. of the sprayer 20.

That is, the set button 15*a* enables a user to set, control, change a reference value for determining whether the outdoor unit 100 is operated, and setting values such as the cycle and pattern of cooling water that is sprayed through the sprayer 20.

Accordingly, the set button 15*a* makes it possible to select the operation module 12 and the control unit 13 and set power and time.

In this configuration, the set button 15*a* can control setting through direct/indirect connection to the adapter 10.

That is, the set button 15*a* may be installed directly at the adapter 10 so that a user can easily operate the set button 15*a*.

Further, the set button 15*a* may be controlled together with the adapter 12 through a USB, a cable, etc.

Further, the set button 15*a* may be controlled through a smartphone, etc. together with the adapter 12 through IOT communication.

Accordingly, the set button 15*a* can change a reference value and setting values together with the adapter 10 in various ways.

The adapter 10 further includes a display 15*b* that shows information set through the set button 15*a*.

The display 15*b* may be formed on the adapter 10 or may be separately connected to be able to show information of the adapter 10 set by the set button 15*a*.

Accordingly, a user can easily check the setting state of the adapter 10.

Next, the sprayer 20 is composed of a supply hose 21, a control valve 22, and a distribution pipe 23 so that it can be installed at the outdoor unit 10 and can be controlled to spray cooling water by the adapter 10.

Cooling water flows into the supply hose 21 from the outside.

Accordingly, the supply hose 21 is connected to a separate storage container keeping cooling water, or a faucet to be able to supply cooling water anytime to the distribution pipe 23.

The control valve 22 is installed on the supply hose 21 and controls supply of cooling water by the control unit 13.

That is, the control valve 22 can adjust inflow by opening/closing to adjust supply of cooling water that flows into it though the supply hose 21.

The control valve 22 is controlled by the adapter 10 and adjusts cooling water that flows into it by opening/closing in accordance with setting values of the control unit 13.

Further, the control valve 22 is controlled directly/indirectly together with the adapter 10.

Accordingly, the control valve 22 is connected to the adapter receives a control signal, and opens/closes to adjust inflow of cooling water, or opens/closes to adjust inflow of cooling water in response to a control signal that is transmitted by communication with the adapter 10.

In this configuration, when the control valve 22 is connected to the adapter, the control valve 22 is operated by micro-current that is supplied to the adapter, and when the control valve 22 is controlled through communication, it is preferable that the control valve 22 is connected to a separate battery or external power for operation.

The distribution pipe 23 is coupled to the outdoor unit 100 and has several spray nozzles 23*a* that spray cooling water coming from the supply hose 21 to the heat exchanger.

Accordingly, cooling water adjusted and supplied through the control valve 22 is directly sprayed to the heat exchanger in a mist type through the spray nozzles 23*a*, whereby it is possible to remove heat of the heat exchanger.

The distribution pipe 23 is formed in various shapes to correspond to the shape of the outdoor unit 100.

That is, when external air is allowed to flow into the outdoor unit 100 from the rear and the side of the outdoor unit 100, several spray nozzles 23*a* are arranged in an L-shape or straightly to be able to efficiently spray water.

Accordingly, the sprayer 20 is configured to be able to spray cooling water coming from the outside as the condensate water by control of the adapter 10.

Further, both ends of the distribution pipe 23 are fixed to the outdoor unit 100.

In this configuration, both ends of the distribution pipe 23 can be fixed to the outdoor unit 100 using various ways such as magnetic coupling, fitting, and thread fastening.

Further, the distribution pipe 23 may be coupled through rails, etc. so that the vertical height of the distribution pipe 23 can be adjusted on the outdoor unit 100.

As described above, the distribution pipe 23 is fixed to the outdoor unit 100 through a simple configuration, so it is possible to reduce the installation cost and easily install the distribution pipe 23.

Further, a safety module 40 that can cut the power of the adapter 10 or can transmit a signal to the outside when the temperature of the outdoor unit 100 is measured and the measured temperature is higher than a set temperature is further included.

The safety module 40 is composed of a temperature measuring unit 41, a determining unit 42, a warning unit 43, and a commanding unit 44.

The temperature measuring unit 41 is installed at the outdoor unit 100 and measures the temperature of the outdoor unit, and various devices such as a sensor that measures an internal temperature like a thermocouple are directly installed at the outdoor unit, thereby measuring an internal temperature.

The determining unit 42 sets a safety temperature of the outdoor unit 100.

On the basis of a temperature set b the determining unit 42, when the temperature measured by the temperature measuring unit 41 is higher than a set temperature, a warning is sent out through the warning unit 43 and the commanding unit 44 or a signal is sent out through the adapter 10 to be able to stop operation of the outdoor unit 100.

Setting for an over-temperature state of the determining unit 42 may be easily adjusted within the range of +50~100° C.

When an over-temperature state is determined with the outdoor unit 100 in operation by the determining unit 42, the warning unit 43 transmits the state of the outdoor unit to a user using various methods such as a sound, a lamp, and IOT communication.

Accordingly, the warning unit 43 may be disposed close to or inside the adapter 100 and may directly transmit the state to a user in a room like a speaker or a lamp or may indirectly transmit the state to a user in a room by operating with external electronic device, communication equipment, etc. through IOT communication, etc.

The commanding unit 44 can stop operation by cutting the power of the adapter 10 when the determining unit 44 determines that the temperature of the outdoor unit 100 is higher than a set temperature.

The commanding unit 44 is directly/indirectly connected to the adapter 10 and operates on the basis of an information value determined by the determining unit 42 through any one of various methods that can cut the power.

Accordingly, the temperature measuring unit 41 is installed at a position where it can easily measure a temperature in the outdoor unit 100.

Further, it is preferable that the determining unit 42, the warning unit 43, and the commanding unit 44 are disposed in the adapter 10 to be able to cut the power on the basis of temperature information transmitted from the temperature measuring unit 41.

As described above, when it is determined that the temperature of the outdoor unit 100 is higher than an existing use temperature, the state is transmitted to a user and operation is stopped, thereby being able to prevent accidents such as a fire, electric leakage, etc.

Further, a circulator 30 that circulates and re-sprays dew, which condensates in the indoor unit 110 and the outdoor unit 100, and cooling water is further included.

Accordingly, the circulator 30 is composed of a collection hose 31, a storage tank 32, and a discharge hose 33 to be able to circulate and supply condensate water and sprayed cooling water to the supply hose 21.

Mixed water produced by collecting and mixing condensate water discharged from the indoor unit 110 and cooling water sprayed to the outdoor unit 110 flows into the collection hose 31.

The collection hose 31 is divided into branches, which are coupled to each other or integrally formed, in a Y- or T-shape and is connected to the indoor unit 110 and the outdoor unit 100, and condensate water and cooling water flows into the collection hose 31.

Further, the collection hoses 31 are separately formed and connected to the indoor unit 110 and the outdoor unit 100, and condensate water and cooling water flows into the collection hoses 31.

The collection hose 31, as described above, can simultaneously or separately receive condensate water and cooling water through various coupling methods.

The storage tank 32 keeps mixed water coming from the collection hose 31 with foreign substances removed through a filter 32*a*.

The filter 32*a* is installed to be replaceable on the storage tank 32 and removes foreign substances mixed in the mixed water coming through the collection hose 31.

Accordingly, mixed water with foreign substances removed by the filter 32*a* is kept in the storage tank 32.

The discharge hose 33 is controlled by the control valve 22 to supply the mixed water kept in the storage tank 32 to the supply hose 21.

As described above, the discharge hose 33 supplies the water kept in the storage tank 32 to the supply hose 21.

The discharge hose 33 is connected to the control valve 22 and controlled by the adapter 10 to supply mixed water together with cooling water to the supply hose 21.

Accordingly, use of cooling water can be reduced.

Next, installation and a use state according to the present disclosure are described.

The adapter 10 is connected to the electrical outlet 200 and then the plug 120 of the air conditioner is connected to the adapter 10.

The sprayer 20 is installed to be able to be supplied with cooling water from the outside and spray the cooling water to the outdoor unit 100.

When the adapter 10 and the control valve 22 are close to each other, they are connected through a cable and a control signal is transmitted, but when they are not close to each other, they are operated such that a control signal is transmitted through communication.

Since the adapter 10 and the sprayer 20 can be simply installed, as described above, they can be easily used for products that are being currently used.

Accordingly, the adapter 10 measures power, which is supplied to the air conditioner, through the measurement module 11.

The power amount measured in this way is used for the operation module 12 to determine the operation state of the outdoor unit 100 on the basis of a reference value set by a user, and when it is determined that the outdoor unit 100 is in operation, the control valve 22 is adjusted in accordance with a setting value of the control unit 13.

A user can change the reference value and the setting value, if necessary, through the set button 15*a* on the basis of various items of information such as the capacity, size, power consumption of the air conditioner.

Further, the control unit 13 opens/closes the control valve 22 in accordance with the setting value, whereby cooling water is sprayed to the heat exchanger in accordance with a specific cycle or pattern.

In this process, the spray nozzles 23*a* sprays cooling water in a mist type, so the cooling water is uniformly sprayed to the entire surface of the heat exchanger by wind blown in the outdoor unit 100.

Further, since cooling water is sprayed in a mist type, the cooling water can flow to and cool even narrow portions in the structure of the outdoor unit 100.

Accordingly, the heat of the heat exchanger is removed by the sprayed cooling water.

Further, a user can save power and cooling water by easily adjusting the reference value and the setting value in accordance with various changing situations such as a position, a place, and an environment.

Further, condensate water and sprayed cooling water are circulated and mixed and re-sprayed with cooling water that is supplied, whereby it is possible to reduce consumption of cooling water.

As described above, the adapter 10 can be easily installed and used, ordinary people can easily use the adapter without help of experts in an installed state or in new installation, and it is possible reduce consumption of cooling water and minimize power consumption by easily adjusting cooling water that is controlled to be sprayed through the adapter 10.

Further, since the sprayer 20 is operated by power of the adapter 10, it can be easily installed to be able to spray cooling water to the heat exchanger in the outdoor unit 100.

Further, since whether the outdoor unit 100 is operated is determined through the adapter 10 and cooling water is sprayed, it is possible to prevent an increase of energy consumption due to an increase of the temperature of the heat exchanger.

AS described above, the present disclosure is not limited to the exemplary embodiments described above and defined by claims, and it is apparent to those skilled in the art that the present disclosure may be modified in various ways without departing from the scope of the present disclosure described in claims.

What is claimed is:

1. An electric adapter type controller for air conditioner outdoor unit auxiliary cooling device, the electric adapter type controller comprising:

an adapter disposed between a plug of an air conditioner and an electrical outlet, and configured to measure used-power; and a sprayer installed at the outdoor unit, and configured to perform spraying of cooling water, which flows inside from the outside, to a heat exchanger in correspondence to used-power of the adapter, wherein the adapter includes:

a measurement module configured to measure consumption of power that is supplied to the plug from the electrical outlet;

an operation module configured to determine an operation state of the outdoor unit by calculating the power measured by the measurement module; and a control unit configured to control the sprayer on the basis of information determined by the operation module, wherein the operation module is further configured to:

compare power measured by the measurement module with a set reference value;

determine that the outdoor unit is not operated when the measured power is smaller than the reference value; and determine that the outdoor unit is in operation and transmit whether the outdoor unit is operated to the control unit, when the measured power is larger than the reference value, and wherein the control unit is further configured to control the sprayer to be able to spray the cooling water in accordance with a setting value, when receiving that the outdoor unit is operated from the operation module, wherein the adapter further includes a power unit configured to supply power to the measurement module, the operation module, and the control unit through rectification by parallel-branching a current that is supplied to the plug from the electrical outlet, wherein the control unit is further configured to set an operation time, a maintenance time, a hold time, and a restart time, and operate the sprayer in accordance with a pattern based on the set times, and wherein the operation time is a time at which the spraying is started when speed of a fan reaches a normal state after the fan starts operating, the maintenance time is a time for which the spraying is maintained from a point in time of starting the spraying after a delay time, the hold time is a time for which the spraying is stopped and held after the maintenance time, and the restart point is a point in time at which the spraying is restarted when the outdoor unit keeps operating even after the hold time.

2. The electric adapter type controller of claim 1, further comprising a set button setting the operation module and the control unit included in the adapter, wherein the set button adjusts the spraying through the operation module and the control unit.

3. The electric adapter type controller of claim 1, wherein the sprayer includes:

a supply hose into which cooling water flows from the outside;

a control valve installed on the supply hose and controlling supply of cooling water by the control unit; and a distribution pipe coupled to the outdoor unit and having several spray nozzles configured to spray cooling water, which comes from the supply hose, to the heat exchanger.

* * * * *